US006695167B2

(12) United States Patent
Bennett et al.

(10) Patent No.: US 6,695,167 B2
(45) Date of Patent: Feb. 24, 2004

(54) CONTAINER FOR HOLDING AND DISPENSING PRODUCT

(75) Inventors: Harold Bennett, St. Joseph, MO (US); Ed Thompson, St. Joseph, MO (US)

(73) Assignee: Nestec S.A., Vevey (CH)

( * ) Notice: Subject to any disclaimer, the term of this patent is extended or adjusted under 35 U.S.C. 154(b) by 51 days.

(21) Appl. No.: 10/094,529

(22) Filed: Mar. 8, 2002

(65) Prior Publication Data

US 2002/0145004 A1 Oct. 10, 2002

Related U.S. Application Data

(60) Provisional application No. 60/278,499, filed on Mar. 23, 2001.

(51) Int. Cl.[7] ..... B65H 1/08
(52) U.S. Cl. ..... 221/56; 221/279
(58) Field of Search ..... 221/33, 45, 56, 221/255, 279, 257; 206/817, 756

(56) References Cited

U.S. PATENT DOCUMENTS 4,646,937 A * 3/1987 Doshi ..... 221/56

FOREIGN PATENT DOCUMENTS

| | | | |
|---|---|---|---|
| DE | 299 08 078 U1 | * | 10/1999 |
| FR | 2 735 340 | | 12/1996 |
| WO | WO 95/04681 | * | 2/1995 |

* cited by examiner

*Primary Examiner*—Kenneth W. Noland
(74) *Attorney, Agent, or Firm*—Bell, Boyd & Lloyd LLC

(57) ABSTRACT

An improved product holding and dispensing a container for housing and dispensing products is provided. The container having a moveable product frame, wherein a consumer is enabled to move the frame, as product units are removed, to maintain the product in its packaged order. The container comprises: a base having a front wall, a back wall and side walls a moveable frame adapted to support the products inside the base. The frame includes a back wall and a member, wherein an area of the member extends through the base to allow the member to be grasped and pulled to cause the back wall of the frame to move away from the back wall of the base.

16 Claims, 3 Drawing Sheets

CONTAINER FOR HOLDING AND DISPENSING PRODUCT

This application claims the benefit of provisional No. 60/278,499 filed Mar. 23, 2001.

BACKGROUND OF THE INVENTION

The present invention relates generally to containers. More particularly, the present invention relates to containers for holding and dispensing product.

These are a variety of containers that are used to house products. In the consumer arena it is desirable not only to provide containers that can store products but also can dispense same to the consumer. This is especially true if products are packaged in individual units. These individual units are typically supplied to a distributor in a carton and designed to be sold to the consumer as individual units.

Of course, in packaging products there are a variety of issues that must be considered. The units need to be packaged in an efficient compact manner. If the packaging housing the packaged units will be used also to display the units. It is necessary that the container do so in an attractive manner that allows the consumer easy access. When consumers remove product units from a package having a plurality of such units, the organization and ordering of the remaining units begins to degrade. The remaining units can become wedged against each other and hard to reach without tearing open the entire container.

The need to provide a mechanism to allow consumers to have access to individual units in an orderly manner must be weighed against the economics of the containers. Typically, the containers that dispense the product are throw away units. Thus, an expensive container that can dispense product in an orderly fashion is not a viable solution. Moreover, the container should be simple to use and easily set up on shelves of the distribution center.

A need therefore exists for a low cost container having the ability to maintain the order and organization of unused product units as well as to provide access to the remaining units as the consumer removes units from the container.

SUMMARY OF THE INVENTION

The present invention provides an improved product for holding and dispensing container as well as improved methods for dispensing products. More specifically, the present invention provides a container having a moveable product frame, wherein a consumer is able to move the frame, as product units are removed, to maintain remaining products in an orderly fashion.

To this end, in an embodiment of the present invention, a container for holding and dispensing products is provided. The container includes a base having a front wall, a back wall and side walls. A moveable frame adapted to support the products inside the base is also provided. The frame includes a back wall and a member, including a portion that extends through the base, allowing the member to be grasped and pulled to cause the back wall of the frame to move away from the back wall of the base.

In an embodiment, the frame is slideably abutting the base.

In an embodiment, the base and frame are constructed from the same material.

In an embodiment, the base and frame are constructed from cardboard.

In an embodiment, the member includes a removable portion.

In an embodiment, the frame includes a bottom that is coupled to the member.

In an embodiment, the member includes a plurality of removable portions differentiated by perforations.

In an embodiment, the front wall includes an aperture adapted to receive the member.

In an embodiment a single member extends through the front wall of the base.

In an embodiment of the present invention, a container for holding and dispensing products is provided. The container includes a base and a moveable frame adapted to support a plurality of products inside the base. The frame includes a back wall, side walls, a bottom and a member. An area of the member extends through the base to allow the member to be grasped and pulled.

In an embodiment, the member is moveably constrained by the base.

In an embodiment, the member includes a removable portion.

In an embodiment, the removable portion comprises a value-representing item.

In an embodiment, the base includes a front wall, side walls, and back wall.

In an embodiment, the member is received into an opening of the front wall.

In an embodiment of the present invention, a method for dispensing value-representing items, including coupons, is provided. The method includes the step of providing a container housing a plurality of individual products, wherein the container has a base and a frame, and wherein the frame is at least partially within the base and supporting the product. The frame in this method also includes a member that extends outside the base. The method also includes the step of encouraging a consumer to grasp and pull the member causing a back wall of the frame to move toward a front wall of the base.

In an embodiment, the step of encouraging includes associating a value-representing item, e.g., a coupon, with the member.

In an embodiment, the step of the step of encouraging includes maintaining the individual products in order when the consumer grasps and pulls the member.

In an embodiment, the step of encouraging includes extending the member from the base when the consumer grasps an pulls the member.

In an embodiment, the method includes the step of enabling removal of a value-representing item.

In an embodiment, the value-representing item is a coupon.

An advantage of the present invention is to provide an improved container for housing products.

Further, an advantage of the present invention is to provide an improved method for dispensing product.

Moreover, an advantage of the present invention is to provide an improved container that facilitates the orderly distribution of individual units of product.

Another advantage of the present invention is to provide an improved method for dispensing value-representing items, including product coupons.

Additional features and advantages of the present invention will be described in and apparent from the detailed description of the presently preferred embodiments.

DETAILED DESCRIPTION OF THE PRESENTLY PREFERRED EMBODIMENTS

Figure 1:
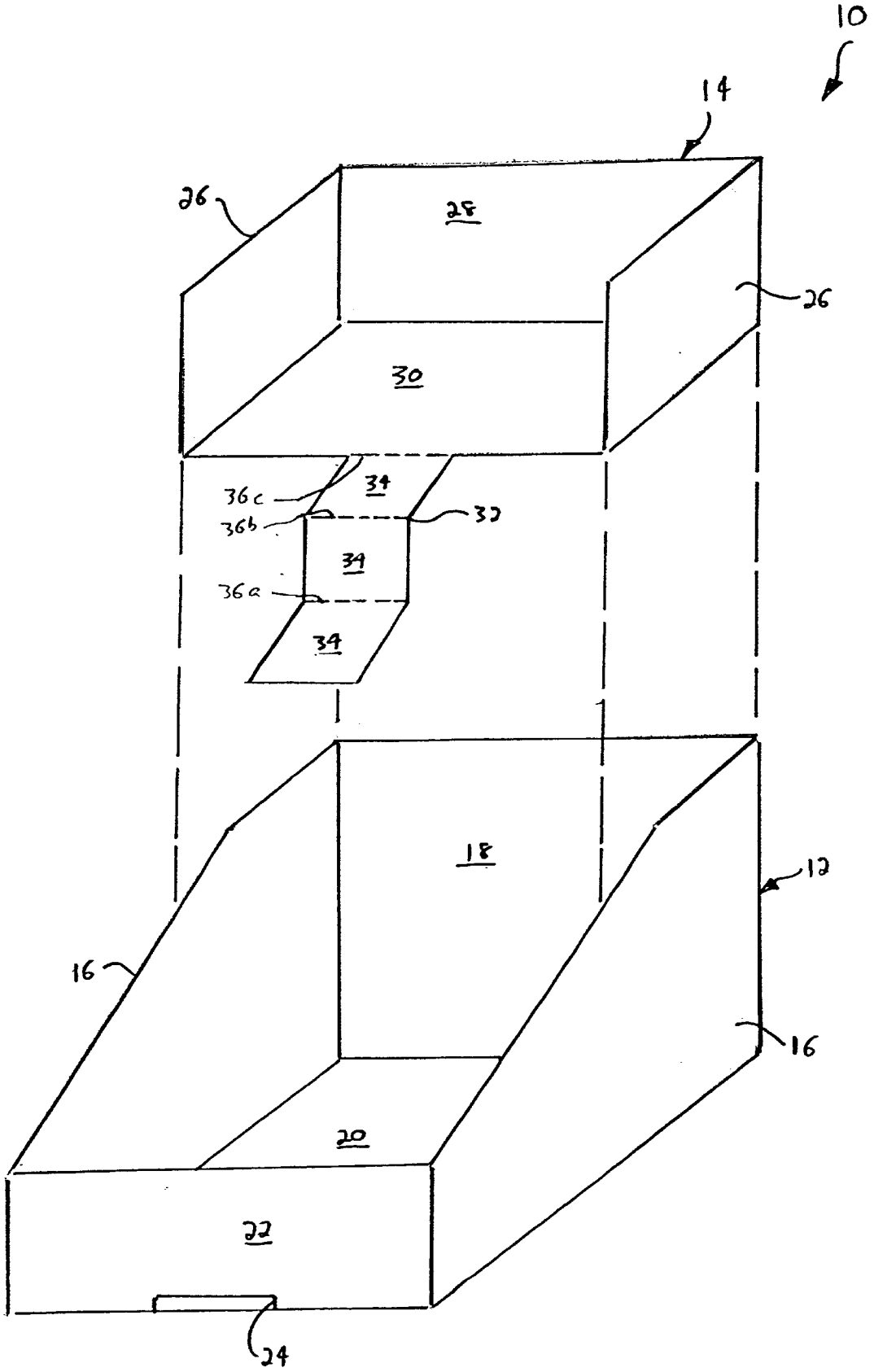
FIG. 1 is an exploded top-front perspective view of a container of the present invention having a base and a frame moveably engaging the base.

Referring now to FIG. 1, an exploded view of the present invention is illustrated. Specifically, a container 10 including a base 12 and a frame 14 is provided. The base 12 and frame 14 are preferably made of a paper product, such as card board, wherein the individual pieces are cut in the flat, folded and formed, e.g., using a suitable adhesive, as is well known in the art. It should be appreciated that the base 12 and frame 14 can however be fabricated from other materials such as plastic, metal or wood. Further, the base 12 and the frame 14 can be made of the same or different materials.

In an embodiment, the base 12 includes a plurality of side walls 16, a back wall 18, a bottom 20 and a front wall 22. In the embodiment, the front wall 22 defines an aperture 24. In another embodiment, only the front wall defines the aperture 24. In the illustrated embodiment, the aperture 24 is defined as a rectangular slot although a variety of shapes can be used. Likewise, although the aperture 24 is shown horizontally disposed, the slot 24 can also be vertically disposed or set at a predetermined angle. The size of the base will be dictated in part by the product to be housed.

The frame 14 includes side walls 26, a back wall 28, and a bottom 30. In addition, the frame 14 includes a member 32. As illustrated, the member 32 is designed to be received by and pass through the aperture 24 of the base 12. The member 32 preferably attaches to the bottom 30 of the frame 14. However, in an embodiment, the member attaches to a side wall 26, in which case the aperture 24 is vertically disposed. It should be appreciated that the frame 14 need not have continuous or solid side walls 26 or back wall 28; rather, the frame 14 may alternatively be partially or wholly a framework that defines the same shape as the illustrated frame 14, but that has one or more material saving openings or apertures defined by the walls. The bottom 30 is preferably solid or has a framework extending perpendicular to the ordering of the product units (described below), so that the framework adequately supports the products.

The member 32 preferably includes a plurality of member portions 34. Perforations 36*a*, 36*b* and 36*c* preferably differentiate or link the member portions 34. Although three perforations are shown, more or less perforations can be provided. In an embodiment, a perforation 36*c* separates the member 32 and the bottom 30. Alternatively, the portion 34 adjacent to the bottom 30 is integral to or otherwise permanently connected to the bottom 30. It should be appreciated that the member 32, including the portions 34, is flexible and foldable and is preferably flexed or folded without damaging the member's integrity or strength.

Figure 2:
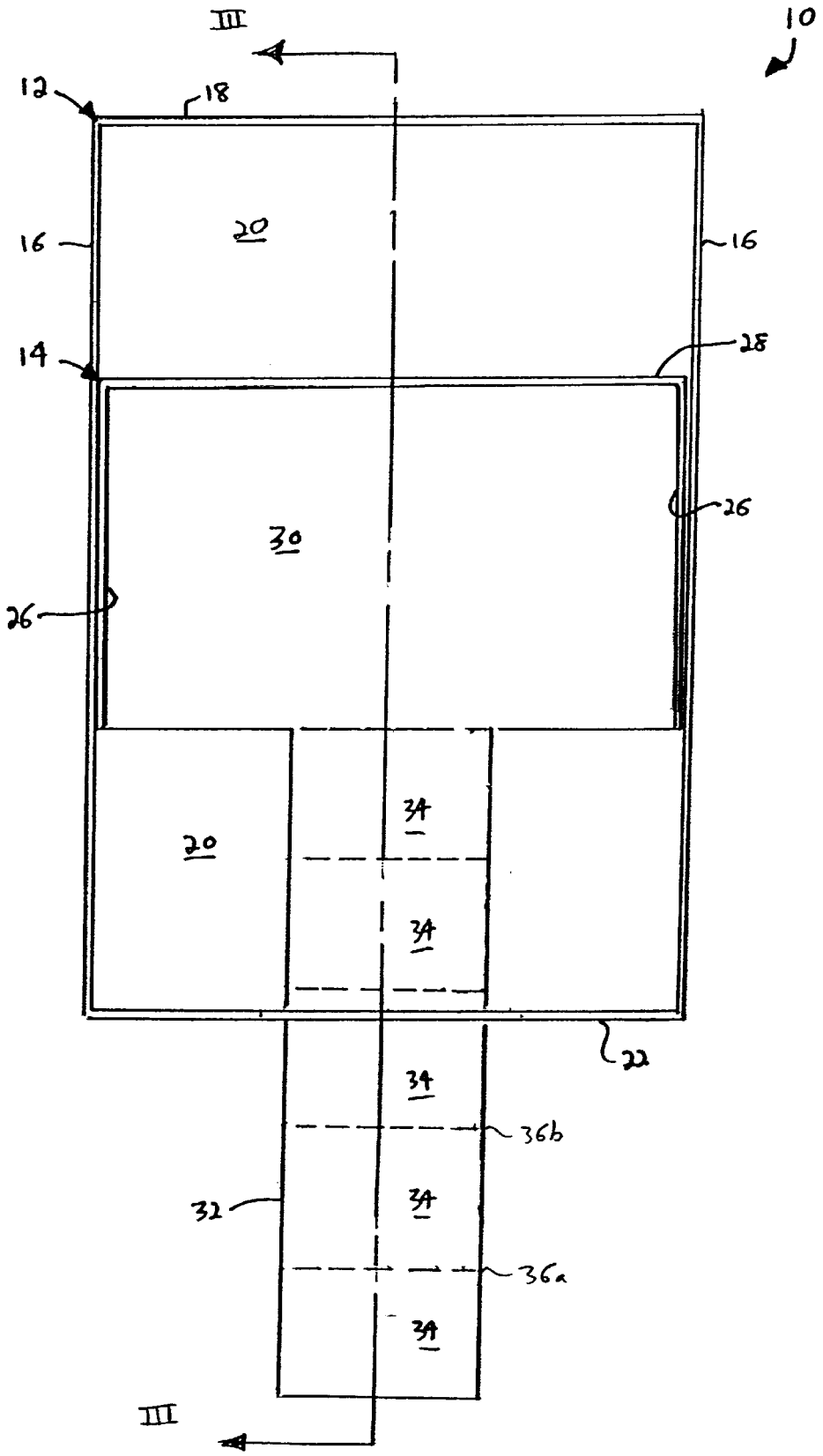
FIG. 2 is a top plan view of an assembled container illustrating the interaction between the base and the moveable frame.

Referring now to FIG. 2, a top view of the assembled container 10 illustrates the frame 14 inserted into the base 12, such that the side walls 26 of the frame 14 fit snugly yet slideably inside the side walls 16 of the base 12. The snug fit provides that the back wall 28 of the frame 14 remains substantially parallel with the back wall 18 of the base 12 throughout the movement of the frame 14 relative to the base 12. The snug fit also preferably provides a frictional force between the side walls 16 of the base and the side walls 26 of the frame 14. The frictional force aids in keeping the frame 14 in position, i.e., from loosening, to maintain the product order. The bottom 30 of the frame 14 slideably abuts the bottom 20 of the base 12, which is further illustrated in FIG. 3.

As illustrated, the member 32 has a plurality of member portions 34 inside the base 12, a plurality of member portions 34 outside the base 12 and a member portion 34 both inside and outside the base 12. When the container 10 is fully loaded with product, the back wall 28 of the frame 14 is adjacent to and preferably abutting the back wall 18 of the base 12. At this time, most of the portions 34 of the member reside inside of the base 12. At least part of a single portion 34 is preferably initially exposed. As the product is consumed, the container 10 is designed to allow a consumer to move the frame 14 towards the front wall 22 of the base 12 whereby additional portions 34 of the member 32 become exposed.

When the consumer engages and pulls the member 32, the frame 14 and the member move towards the front wall 22 and a portion 34 becomes completely exposed, i.e., a perforation joining a portion 34 to the member 32 becomes exposed. The consumer can then tear the completely exposed portion 34 from the member 32 along its associated perforation. In one preferred embodiment, the length of a portion 34 is substantially the same as the width of the products shown below, so that pulling the member 32 the length of one portion 34 consumes the space of one removed product unit. In this manner, the number of portions 34 preferably equals the number of product units, whereby the removal of each product unit enables a portion to be grasped, pulled and removed.

Figure 3:
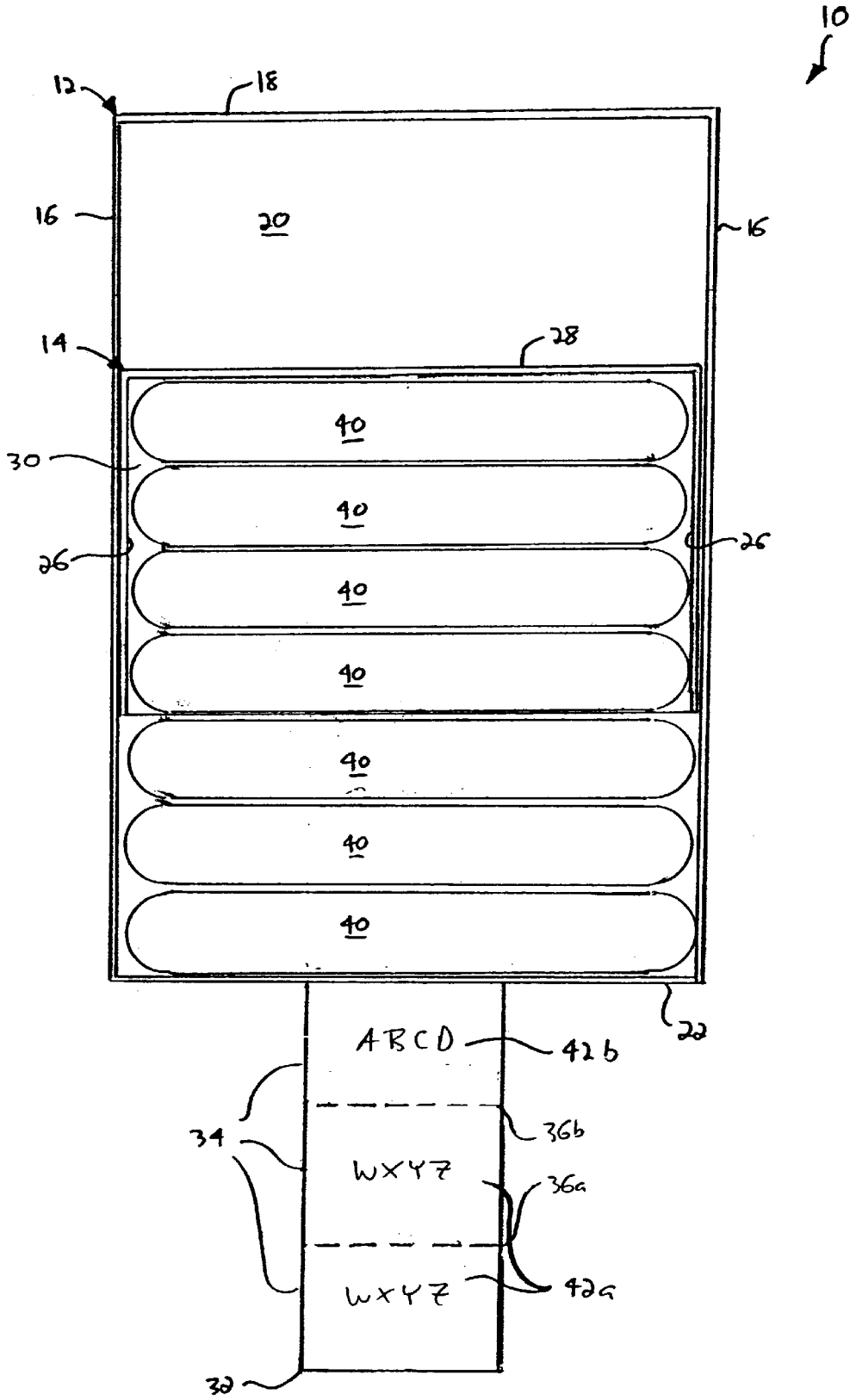
FIG. 3 is a top plan view of an assembled container loaded with product further illustrating the interaction between the product, the base and the moveable frame as well as the value-representing item of the present invention.

Referring now to FIG. 3, a top view of the assembled container 10 illustrates the frame 14 inserted into the base 12, such that the side walls 26 of the frame 14 fit snugly inside the side walls 16 of the base 12. A plurality of product units 40 are substantially vertically disposed inside the frame 14. The container 10 alternatively includes maintaining other units that are substantially square in cross section. The container 10 further alternatively includes being operatively vertically disposed, such that gravity compresses the product units 40 onto the front wall 22 of the base and such that the product units 40 are thereby horizontally disposed.

The removal of a product unit 40 creates open space between the front wall 22 of the base 12 and the back wall 28 of the frame 14 and slack between the product units 40. The remaining upright units 40 may tilt or shift. The member 32 enables the consumer or user of the product units 40 to engage or grab the frame 14 on one or more of the member portions 34 and pull the member 32 and the bottom 30 (covered by product units 40), which are both connected to the frame 14, through the aperture 24 (see FIG. 1) of the front wall 22. Certain portions 34 of the member 32 and the bottom 30 are thus moveably or slideably abutting the bottom 20 of the base 12. The member 32 is preferably thick enough, e.g., 0.025 inch (0.64 mm), and of a suitable material, to resist tearing while being pulled and bearing the weight of the product units 40. The perforations 36 also include having a suitable amount of unslit material to resist tearing while being pulled and bearing the weight of the product units 40. As illustrated, other portions 34 of the member 32 are not moveably or slideably abutting the bottom 20, are open and exposed and are available for a consumer or user to engage or grab.

When the user or consumer moves or slides the frame 14 towards the front wall 22 of the base 12, the area between the back wall 28 of the frame 14 and the back wall 18 of the base 12, i.e., the area of exposed side wall 16, increases. When the consumer moves frame 14, the back wall 28 contacts a product unit 40 and imparts a force on the product units 14. As the consumer continues to move the frame 14, the product units 40 move and contact each other until no more open space or slack created by the removed unit remains. At this point, the product units 40 can no longer move because the front wall 22 imparts an equal and opposite force on the product units 40. The compressive force maintains the remaining product units 40 in their packaged, e.g., upright, order. The present invention enables the above process to be repeated for a plurality of product unit removals, i.e., until no portion of the frame 14 can pass through the aperture 24 of the front wall 22.

FIG. 3 illustrates that a plurality of product units 40 have been removed from the container 10 such that a portion of the bottom 20 of the base is visible. Also, a plurality of portions 34 of the member 32, separated by perforations 36*a* and 36*b*, are exposed and available for a consumer to engage or grab to further pull the frame 14 towards the front wall 22 of the base 12.

The exposed area of the member 32 and the portions 34 thereof illustrate a further feature of the present invention. The member 32 includes one or more portions 34 comprising a value-representing item having indicia. In one embodiment the value-representing item is a coupon. In the present illustration, each portion 34 includes a separate value-representing item. The indicia of the value-representing item includes being the same for different value-representing items, as illustrated by the indicia 42*a* appearing on two separate portions 34. The indicia of the value-representing items also includes being different for different value-representing items, as illustrated by the indicia 42*a* and 42*b* appearing on two separate portions 34. The value-representing items of the present invention include being any type of value-representing item or coupon known in the art, for example, product discounts, product giveaways, promotional giveaways, contests, etc. Although not illustrated, the present invention includes two or more portions 34 having indicia that in combination form a value-representing item.

When a value-representing item becomes exposed, i.e., when one or more portions 34 become exposed, the consumer can tear the value-representing item, along the perforation, from the remaining member 32, and redeem the value-representing item for its value. The container 10 provides a value-representing item dispensing process that rewards a user for consuming the product units 40. Further, the value-representing items encourage the consumer to move the frame after consuming a product.

In an alternative embodiment, the front wall 22 of the base 12 defines a plurality of vertically disposed apertures 24, similar in shape to the aperture illustrated in FIG. 1. The frame 14 includes side walls 26 that horizontally extend past the bottom of the frame to form two flaps or tabs. The flaps or tabs contain perforated value-representing item portions on their ends. The vertically disposed apertures 24 receive the value-representing item bearing flaps or tabs of the side walls 26, which extend outside the base 12.

This embodiment operates substantially the same way as disclosed above. After removing a product unit from the alternative container, the consumer engages or grabs the exposed flaps or tabs of the side walls 26 and pulls the frame 14 including its back wall 28 against the remaining product, which moves to fill the open space or slack left by the removed unit. Eventually, all space or slack is eliminated, whereby the back wall 28 and front wall 22 compress the remaining product units and maintain their packaged order. The side walls 26 of the frame 14 preferably fit snugly inside the side walls 16 of the base 12, so that their engagement produces a frictional or holding force that tends to keep the frame 14 from loosening.

In another alternative embodiment, the back wall includes a tab or handle that extends above the product and provides an open or exposed area of the frame 14, which a consumer uses to compress and remove open space and slack caused by the removal of a unit of product. The portions 34 of the member 12 are therefore not necessary to remove space or slack in the product of the container but preferably are included to provide value-representing items. The portions 34 can therefore be of a thinner material. As before, the side walls 26 of the frame 14 preferably fit snugly inside the side walls 16 of the base 12, so that their engagement produces a frictional or holding force that tends to keep the frame 14 from loosening.

It should be understood that various changes and modifications to the presently preferred embodiments described herein will be apparent to those skilled in the art. Such changes and modifications may be made without departing from the spirit and scope of the present invention and without diminishing its attendant advantages.

We claim:

1. A container for holding and dispensing products comprising:

a base having a front wall, a back wall and side walls; and a moveable frame adapted to support the products inside the base, the frame including a back wall and a member, wherein an area of the member extends through the base to allow the member to be grasped and pulled to cause the back wall of the frame to move away from the back wall of the base, and wherein the member includes a removable portion including a value-representing item that is redeemable for value.

2. The container of claim 1, wherein the frame is slideably abutting the base.

3. The container of claim 1, wherein the base and frame are constructed from the same material.

4. The container of claim 1, wherein the base and frame are constructed from cardboard.

5. The container of claim 1, wherein the frame includes a bottom that is coupled to the member.

6. The container of claim 1, wherein the member includes a plurality of removable portions differentiated by perforations.

7. The container of claim 1, wherein the front wall includes an aperture adapted to receive the member.

8. The container of claim 1, which includes a single member that extends through the front wall of the base.

9. A container for holding and dispensing products comprising:

a base; and a moveable frame adapted to support a plurality of products inside the base, the frame including a back wall, side walls, a bottom and a member, wherein an area of the member extends through the base to allow the member to be grasped and pulled, and wherein the member includes a removable portion including a value-representing item that is redeemable for value.

10. The container of claim 9, wherein the member is moveably constrained by the base.

11. The container of claim 9 wherein the base includes a front wall, side walls and back wall.

12. The container of claim 11, wherein the member is received into an opening of the front wall.

13. A method for dispensing value-representing items comprising the steps of: providing a container housing a plurality of individual products, the container including a base and a frame, the frame being received at least partially within the base and supporting the product, the frame including a member that extends outside the base; and encouraging a consumer to grasp and pull the member causing a back wall of the frame to move toward a front wall of the base wherein the member includes a removable portion including a value-representing item that is redeemable for value.

14. The method of claim 13, wherein the value-representing item is a coupon.

15. The method of claim 13, wherein the step of encouraging includes maintaining the individual products in order when the consumer grasps and pulls the member.

16. The method of claim 13, wherein the step of encouraging includes extending the member from the base when the consumer grasps and pulls the member.

* * * * *